US007223061B2

(12) United States Patent
Gelb

(10) Patent No.: US 7,223,061 B2
(45) Date of Patent: May 29, 2007

(54) BOOM

(75) Inventor: Herbert Gelb, Hockenheim (DE)

(73) Assignee: Deere & Company, Moline, IL (US)

( * ) Notice: Subject to any disclaimer, the term of this patent is extended or adjusted under 35 U.S.C. 154(b) by 515 days.

(21) Appl. No.: 10/780,425

(22) Filed: Feb. 17, 2004

(65) Prior Publication Data

US 2004/0165978 A1 Aug. 26, 2004

(30) Foreign Application Priority Data

Feb. 21, 2003 (DE) ..... 103 07 689

(51) Int. Cl.
*E02F 3/38* (2006.01)

(52) U.S. Cl. ..... 414/680; 52/111; 52/118; 212/177

(58) Field of Classification Search ..... 414/680, 414/694, 722; 212/175, 177; 52/111, 115–118
See application file for complete search history.

(56) References Cited

U.S. PATENT DOCUMENTS

| | | | | |
|---|---|---|---|---|
| 3,985,248 A | | 10/1976 | Liegel et al. | 214/141 |
| 4,214,665 A | * | 7/1980 | Newman | 57/726.2 |
| 4,382,743 A | * | 5/1983 | Newell | 414/692 |
| 5,163,335 A | * | 11/1992 | Isom et al. | 74/6 |
| 5,494,397 A | | 2/1996 | Wilson | 414/728 |

FOREIGN PATENT DOCUMENTS

| | | |
|---|---|---|
| DE | 41 002 | 8/1962 |
| DE | 41 004 | 9/1962 |
| DE | 68 068 | 11/1968 |
| DE | 23 50 701 | 10/1973 |
| DE | 36 15 295 | 5/1986 |
| DE | 40 22 275 | 7/1990 |
| DE | 41 01 582 | 1/1991 |
| EP | 0 623 092 | 11/1994 |
| NL | 9 401 774 | 6/1996 |

OTHER PUBLICATIONS

Patent Abstracts Of Japan vol. 1998, Jan. 30, 1998—& JP 09 228691 A (Kubota Corp.), Sep. 2, 1997.

* cited by examiner

*Primary Examiner*—Donald Underwood

(57) ABSTRACT

A boom for a telescopic loader, is described. It is proposed that the boom be configured with a carrier arrangement having one end fastened to a frame of the loader vehicle, free to pivot, and having a second free end defined by an attaching flange. A front piece includes a mating flange configured complementary to the attaching flange and releasably secured to it. The front piece is used to engage a tool. To enlarge this modular configuration, an extension carrier is provided that includes a further mating flange and a further attaching flange. By inserting the extension carrier between the front piece and the carrier arrangement, the boom can be extended to conform to special operating requirements. Furthermore, the modular configuration permits a more flexible configuration of the carrier arrangement and the front piece and has a more favorable effect regarding manufacture, handling and transport of the carrier arrangement and the front piece. Also, the range of working can be further expanded by constructing the carrier arrangement so as to include telescoping carriers, with the outer-most carrier being provided with a flange for attachment either to the extension or to the front piece.

7 Claims, 8 Drawing Sheets

BOOM

FIELD OF THE INVENTION

The invention concerns a boom for a loader vehicle, preferably a telescopic loader.

Booms for loader vehicles, particularly telescopic booms, are offered for sale in the market in various configurations. As a rule a telescopic boom includes a carrier arrangement that consists of an outer carrier and one or more inner carriers, where the inner carrier or carriers are supported in bearings or guided in telescoping manner on the inside of the outer carrier. The individual components can be guided in telescoping manner to extend or retract by means of an actuating arrangement. The one end of the boom is usually fastened to the vehicle so that it can be rotated or pivoted, where the other end of the boom includes a front piece which engages a tool, for example, a transport fork or a gripper. With the use of a further hydraulic arrangement, a boom for accomplishing loader operations can be raised or lowered. In the configurations known in the state of the art, the front piece of the boom that is configured to accept a tool is fastened rigidly, so that it cannot be removed, to the outermost end of the last or inner most carrier of the telescopic carrier arrangement. Usually these are weldments in which the front piece and the outermost extensible carrier is configured as a one-part weldment.

BACKGROUND OF THE INVENTION

U.S. Pat. No. 5,494,397 discloses a load handling arrangement that is provided with a telescopic boom that contains several sections supported in a telescopic manner, where the sections represent carriers that can be extended and retracted by means of a hydraulic cylinder and a chain drive. The outermost extensible (and innermost guided) section is provided with a front piece that engages a loader fork, where the front piece is rigidly connected, so that it cannot be removed, to the outermost extensible section.

U.S. Pat. No. 3,985,248 discloses a telescopic boom arrangement that is provided with an outer carrier fastened to the frame of a loader vehicle in whose interior an inner carrier is supported in bearings in a telescopic manner and can be moved relative to an outer carrier. At one end of the inner carrier a loader fork is fastened that can be oriented hydraulically, where the fastening arrangement for the loader fork is configured as a part of the inner carrier or is connected rigidly with the inner carrier so that it cannot be removed.

As shown in the state of the art, the attaching devices or the front pieces used to engage the tool are configured as combined parts combined with those of the innermost carrier. The combined configuration makes it more difficult to manufacture the bearing and/or connecting points on the carrier as well as the installation of hydraulic or mechanical components. Moreover the combined configuration makes the handling, the transport, the painting or finishing and the final assembly of the carrier more difficult, which increases the production cost. Beyond that the combined configuration results in an invariable maximum operating height for the boom and a variable configuration of the boom as to function and operating area is not possible.

SUMMARY OF THE INVENTION

The task underlying the invention is seen as that of defining a boom for a loader vehicle of the aforementioned type through which the above problems are overcome. In particular the boom is to be configured in such a way that manufacturing steps, handling, transport and final assembly are simplified. Furthermore the boom should be capable of variation in length beyond its pre-determined operating range with simple means at low cost and permit easy upgrading or rebuilding, so that a user can make the boom conform to his needs.

According to the invention, a boom of the aforementioned type includes a carrier arrangement that is fastened with one end, free to pivot, to the frame of the loader vehicle and that contains an attaching flange at its free end. Moreover the boom contains a front piece that is provided with a mating flange, where the mating flange can be attached to the first attaching flange and the front piece is used to engage a tool. Thereby the boom represents a multi-part configuration or a modular configuration where the front piece is connected over a flange connection interface to the carrier arrangement, which leads to smaller individual components compared to a combined one-piece carrier and front piece component and that the carrier arrangement as well as the front piece can be manufactured, transported, handled and installed independently of each other. Thereby the entire production of the boom can be improved as well as configured as variable in length and at lower cost. The manufacture of the carrier arrangement and the front piece independently of each other permit a greater flexibility in the manufacture, the precision fitting and the configuration of the components. In that way, for example, various designs of front pieces can be manufactured, each of which is characteristic of a special tool and does not represent a compromise solution. Moreover, a multiplicity of manufacturing methods is possible, for example, the application and/or the combination of welded, cast or even forged components. The entire product palette of a boom or a loader vehicle can be configured in a multiplicity of ways, so that carrier arrangements of varying configurations with differing cross sections and operating lengths can be offered for sale without significantly increased production costs.

In a particularly preferred embodiment of the invention, the carrier arrangement includes a first carrier whose one end is the first end and on whose second end the front piece can be attached. This configuration of the carrier arrangement represents a cost effective base version of a telescopic loader that is the equivalent of a simple wheel loader. The advantage compared to a conventional wheel loader consists in the fact that, on the one hand, various front pieces and, on the other hand, variously configured carrier arrangements with differing cross sections and operating lengths can be offered for sale without significant increases in production cost.

In a further preferred embodiment of the invention, the carrier includes a first carrier and at least one second carrier, where the second carrier is guided in a telescopic manner in the first carrier and the front piece can be fastened to the free end of the second carrier. The second carrier is guided so as to telescope in the first carrier, thereby a variable operating length of the boom is provided, where the boom is built up on the base version with only one carrier. Here the free end of the second carrier is provided with an attaching flange to which the front piece can be fastened. This configuration of the invention represents a telescopic loader that is also provided with all the advantages of the base version. Beyond that, the telescopic arrangement of the two carriers makes it possible to obtain a variable operating length, as is usual for a telescopic loader. In contrast thereto, the advantage is offered of modifying the telescopic loader in a simple re-building, for example, to attain a weight reduction or higher transport loads or higher load capacity. For this purpose the telescopic carrier can be separated from the front piece and disassembled or removed from the first carrier and the front piece attached again to a flange provided on the first carrier. By removing the carrier that is guided in the inside, the total weight of the boom is reduced. The weight "saved" permits heavier loads to be carried by the first carrier that was designed for the total load capacity. In the case of several carriers that are guided or supported in bearings telescoped inside each other, for example, in an arrangement of a total of three carriers in which the second carrier is guided or supported in bearings and telescoped within the first carrier and a third carrier is guided or supported in bearings telescoped within the second carrier, a weight reduction or a downsizing on the basis of other requirements can be reached. The front piece at first attached to the third carrier is separated from the attaching flange and can be attached again as desired to the first or the second carrier to an attaching flange available there (after the third carrier and, if necessary, also the second carrier have been removed). In the same way an upgrading of a wheel loader or a telescopic loader is also conceivable. In this way a multiplicity of combinations are available that make it possible to make the boom of the vehicle conform better to the requirements with simple modifications. In carrier arrangements containing more than three carriers, the changes can be accomplished in an analogous manner.

In a further particularly preferred embodiment of the invention, the carrier arrangement includes at least one extension carrier which contains a second mating flange at its one end and a second attaching flange at its other end and can be fastened between the carrier arrangement and the front piece, where the front piece can be fastened to the second attaching flange. This modular configuration of the boom opens further advantageous possibilities to the user of conforming to the operating requirements of the loader vehicle or the boom in addition to the advantages described previously. In that way, a telescopic carrier arrangement of a telescopic loader as well as the carrier arrangement of the base version or the carrier arrangement of a simple wheel loader can be varied in addition in its operating length. If for particular applications the existing operating height of the boom is not adequate, it can be expanded by such an extension carrier. Here the extension carrier is fastened between the front piece and the carrier arrangement. Here the extension carrier is provided with the corresponding flange arrangement of the attaching flange and of the mating flange, which is also provided for the carrier and the front piece of the boom. This modular configuration is particularly important when, for example, a simple wheel loader is available and only a small extension is missing to meet the required operating height. By means of an extension carrier with which the carrier can be extended, a user can utilize his existing wheel loader and upgrade it in a relatively simple way and at low cost. Thereby the user can avoid costly investments. The same applies to existing telescopic loaders, that can be expanded or upgraded by an extension carrier. Here the extension carriers may be available in several sizes or lengths, so that several extension possibilities are offered. Furthermore the modular configuration permits several extension carriers to be attached to each other by flanges in order to further increase the operating height. In this way a manufacturer can also offer for sale a many-sided and expansive production palette for booms at low cost.

A particularly preferred embodiment of the invention provides that the front piece contain at least one cast component. Moreover the front piece may also be configured essentially completely as a casting. The configuration of the front piece or at least parts thereof as castings permits a flexible design and thereby an improved conformity to the application and to the tool. In particular, at larger production quantities shorter production times are attained in contrast to a welded configuration and a lower cost results. By a corresponding material selection and casting design, for example, reinforcing ribs or cast-in struts, similarly high strength values can be achieved as with welded pure steel designs. Moreover, by proper casting design processing steps for fits, bolt holes and bearings, retaining arrangements and attaching points can be reduced.

In a further preferred embodiment of the invention, the carriers contained in the carrier arrangement are configured as round, box or multiple edge profiles. These are carrier profiles, that are provided with a generally closed outer surface and are provided with a high moment of inertia on the basis of their design. Carrier profiles of this type or steel section profiles may be welded designs or drawn or formed full profiles, that can be manufactured in a variety of cross section sizes, so that they can be guided within each other.

In a further preferred embodiment of the invention, the flanges contained in the boom extend radially outward and/or inward relative to the longitudinal axis of the carrier. Here a flange extending radially inward can be used simultaneously as a bearing support point for the telescopically guided carrier. For a better assembly or disassembly the flanges extend radially outward, so as to provide better access to the flange connection interface. Furthermore this arrangement provides a smaller cross section of the carrier profile, since the carriers can then be guided in a closer spacing to each other. Beyond that, with the flanges extending radially outward, a uniform cross section size of the flange connection interface can be attained without encountering any design limitations.

In a further preferred embodiment of the invention, the flanges contained in the boom are arranged perpendicular or inclined to the longitudinal axis of the carrier. In special cases it may be advantageous for reasons of design or for reasons of strength or of load, to arrange the flange connection interface not perpendicular to the longitudinal axis of the carriers. Here the invention provides that the various flange connection interfaces are provided with parting surfaces independently of each other that are perpendicular or inclined to the longitudinal axis of the carriers.

In a further preferred embodiment of the invention, the various flanges are connected to each other by threaded connections. For this purpose the flanges are provided with bores distributed around their circumference which may be provided with through holes as well as with threads. Corresponding to the bores with or without threads, threaded screws with or without threaded nuts may be used. Furthermore, other threaded connections with equally acting threaded pins or bolts are also conceivable. Furthermore, snap fasteners attached to the flanges or collars are conceivable, that hold the flanges together and permit rapid assembly or disassembly.

BRIEF DESCRIPTION OF THE DRAWINGS

The drawing shows four embodiments of the invention on the basis of which the invention as well as further advantages and advantageous further developments and embodiments of the invention shall be explained and described in greater detail in the following.

DESCRIPTION OF THE PREFERRED EMBODIMENTS

Figure 1:
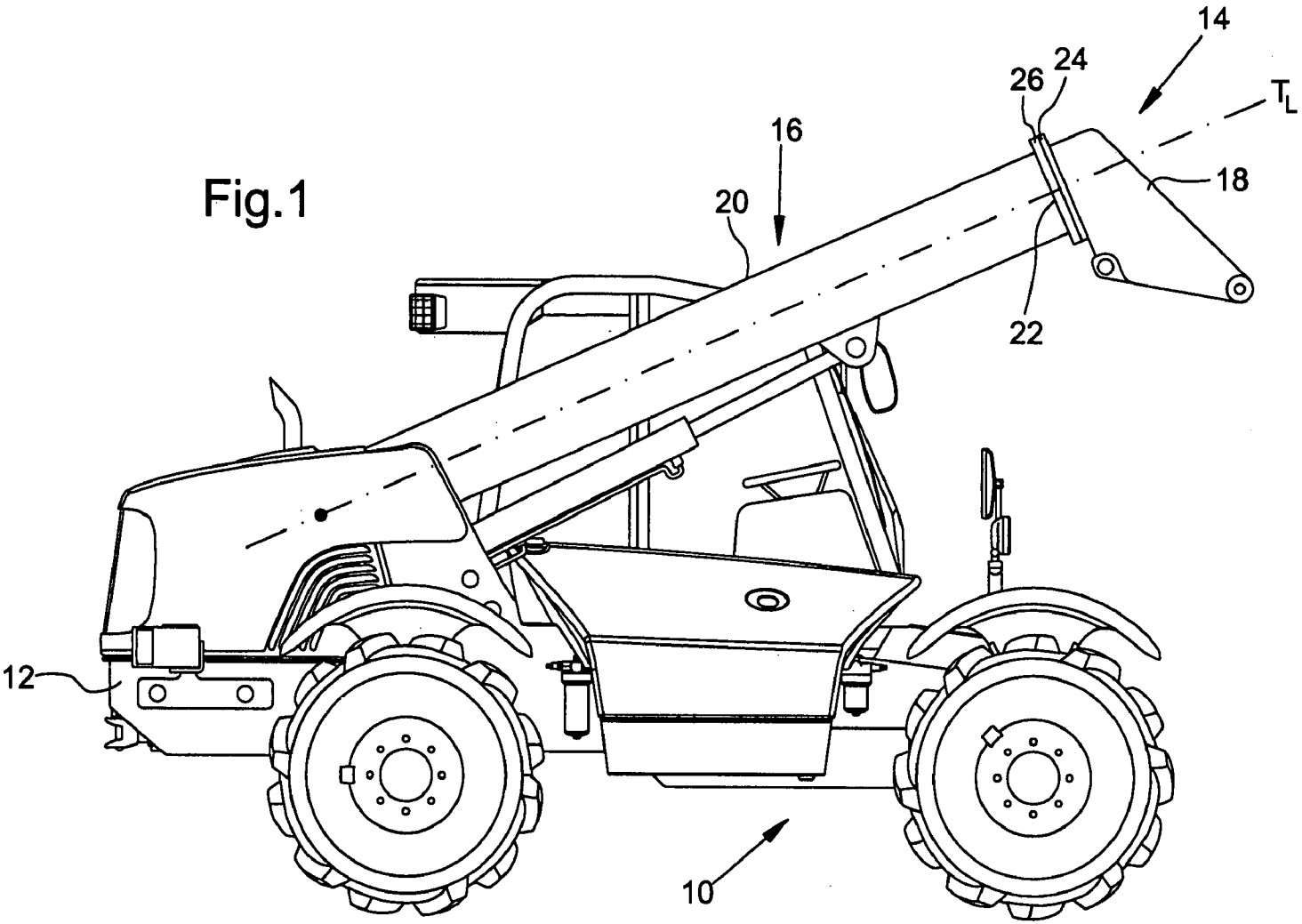
FIG. 1 is a right side view of a telescopic loader equipped with a boom including a first embodiment of a carrier arrangement constructed according to the invention.
Figure 2:
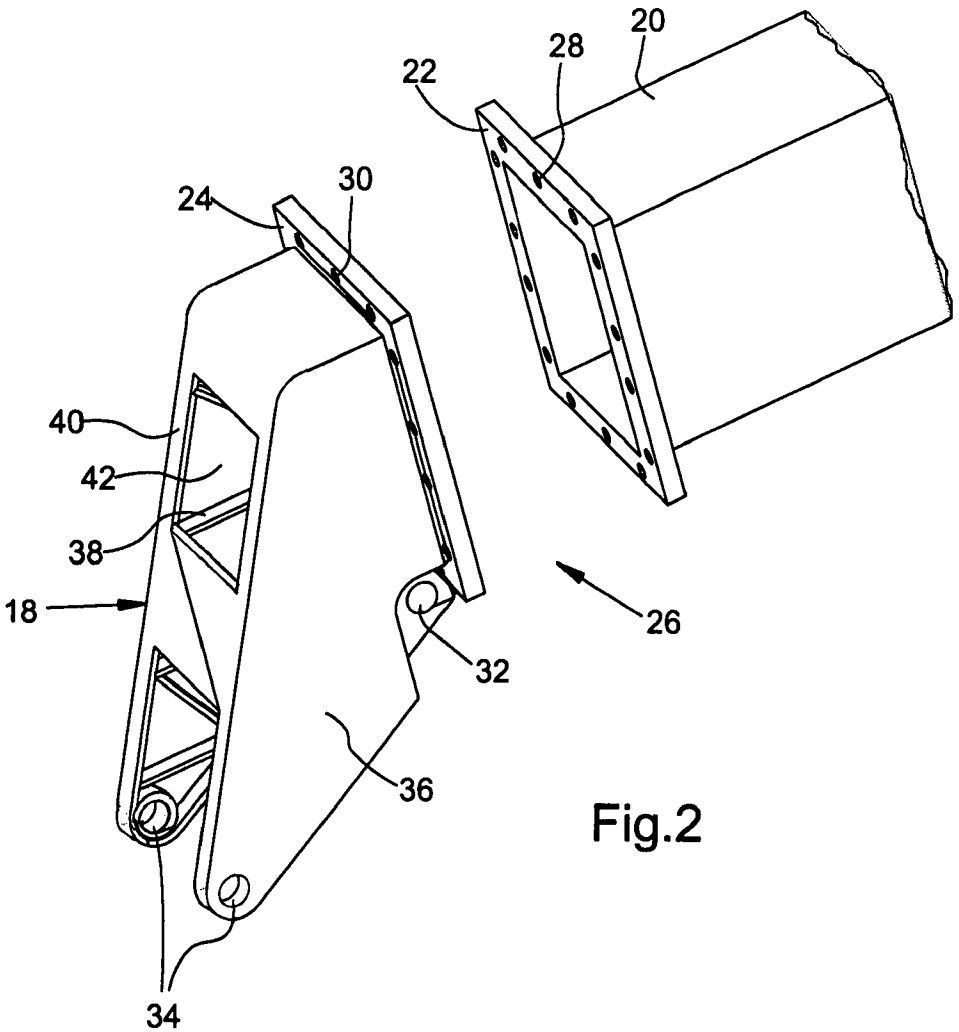
FIG. 2 is an exploded perspective view of the carrier arrangement shown in FIG. 1.

FIG. 1 shows a telescopic loader 10 that includes a boom 14 connected in joints to a frame 12, free to pivot. The boom 14 includes a carrier arrangement 16 to which a front piece 18 is fastened that engages a tool (not shown). The carrier arrangement 16 includes a hollow carrier 20, which is preferably a box profile carrier provided with a rectangular profile, to whose upper or outer end an attachment flange 22 is welded and whose lower or inner end is connected to the frame 12 of the loader 10 by structure (not shown) which establishes a joint defining a horizontal transverse axis about which the boom carrier 20 may pivot vertically. The embodiment shown in FIGS. 1 and 2 is a telescopic loader 10 with a carrier arrangement 16 that contains only one carrier 20 and is therefore not telescopic. In this configuration the telescopic loader 10 operates as a wheel loader or the base version of a telescopic loader 10. The front piece 18 includes a mating flange 24, that is configured correspondingly to the attaching flange 22 and engages the flange 22 at a flange connection interface 26, as is shown in FIG. 2. Here the mating flanges 22 and 24 are clamped or secured together at the interface 26 by threaded pins (not shown), that penetrate through holes 28 in the attaching flange 22 and engage corresponding threaded bores 30 provided in the mating flange 24. Preferably the flange 22 is provided with three bores 28 on each of upper and lower flange surfaces, and with four bores 28 on each of flange on opposite side surfaces. Similarly, the flange 24 is preferably provided with three bores 30 on each of upper and lower flange surfaces and with four bores 30 on each of opposite side surfaces, as is shown in FIG. 2. Depending on the size of the boom 14 as well as on the shape of the cross section of the carrier 20, the upper and lower as well as the side bores 28 and 30 may vary in their quantity and position. As shown in the figures, the flanges 22 and 24 extend vertically and radially outward with respect to the longitudinal axis $T_L$ of the carrier 20. Other configurations such as, for example, flanges 22, 24 extending radially inward or inclined with respect to the longitudinal axis $T_L$ of the carrier 20 are also possible.

As shown in FIG. 2, the front piece 18 is preferably configured as a casting, where the mating flange 24 is a component of the front piece 18. In a further embodiment, however, the mating flange 24 may also be rigidly connected by means of a welded connection to the cast front piece 18. Moreover, the front piece 18 may also be configured as a welded design. The cast design of the front piece 18 shown in FIG. 2 is provided with bores 32 and 34 to which the tool as well as hydraulic devices (both not shown) can be fastened. Side walls 36 of the front piece 18 are provided with reinforcing ribs 38 which increase the stiffness of the front piece 18. Moreover, a recess 42 is arranged on a front side 40 of the front piece 18 that provides weight reduction of the front piece 18. The configuration of the front piece 18, particularly the bores 32 and 34, the reinforcing ribs 38 and the recess 42, is shown here only as an example and can be varied according to the application in shape, size and design. Furthermore, a configuration of the front piece 18 as a welded design is also possible.

As is shown in FIGS. 1 and 2, in the first embodiment, the front piece 18 is attached by a flange to the carrier arrangement 16 which includes only one carrier 20. As shown by the following embodiments according to the invention, other modular arrangements or variations are also possible. For the description of the further embodiments in the following figures the same part number call-outs are used for the same design elements as in FIGS. 1 and 2.

Figure 3:
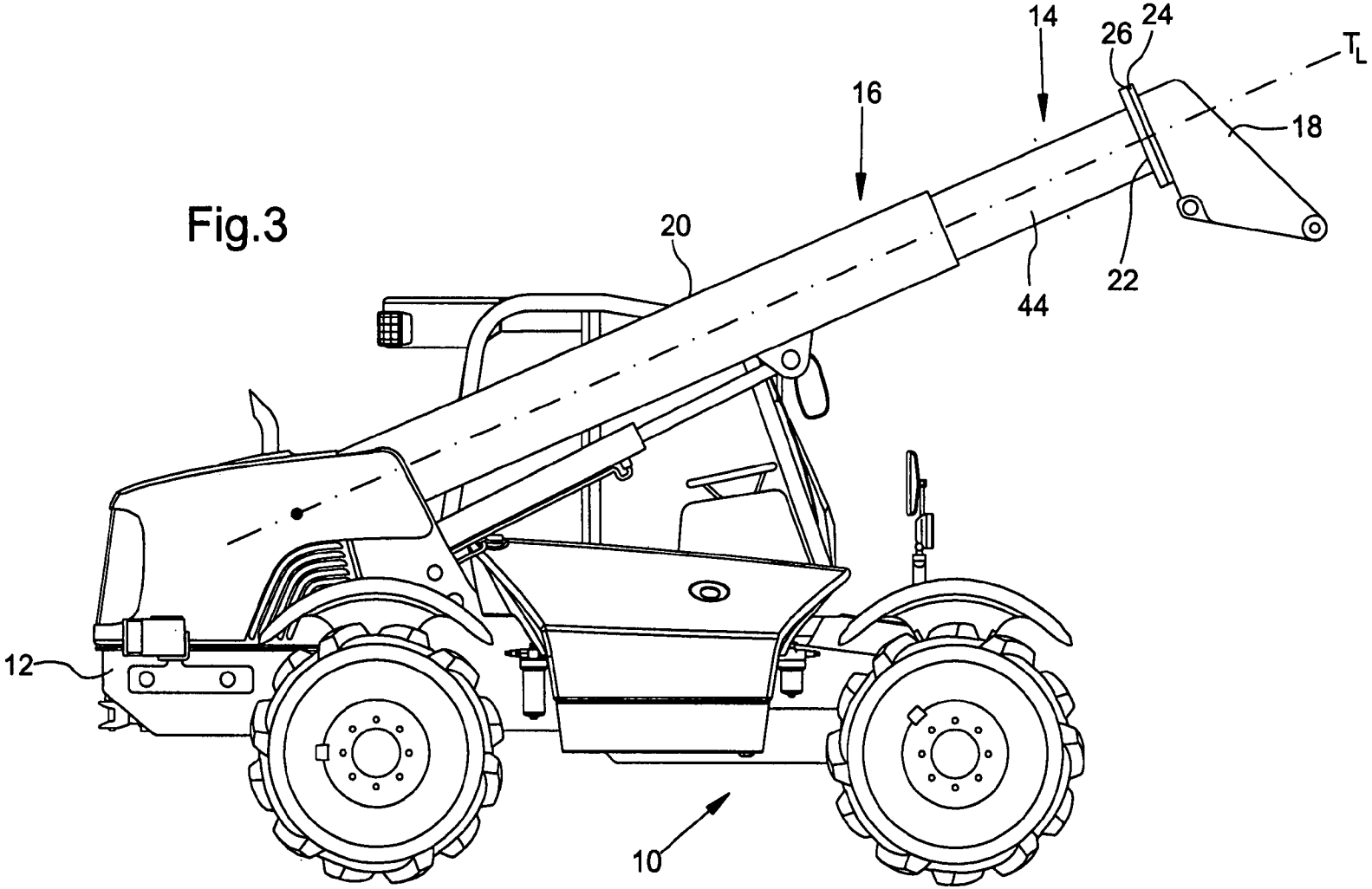
FIG. 3 is a right side view of a telescopic loader equipped with a boom including a second embodiment of the carrier arrangement constructed according to the invention.
Figure 4:
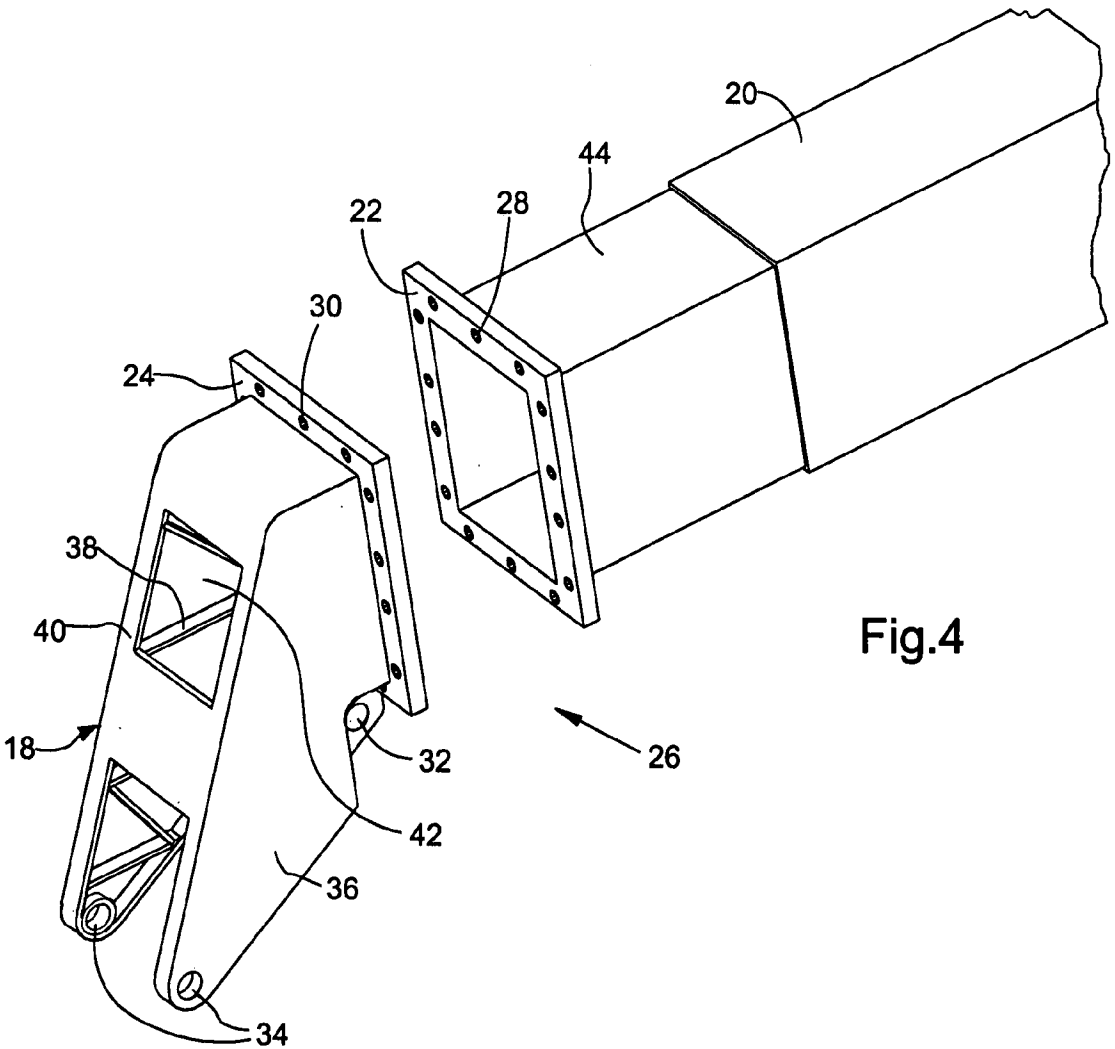
FIG. 4 is an exploded perspective view of the carrier arrangement shown in FIG. 3.

FIGS. 3 and 4 show a second embodiment of the invention with a telescopic loader 10 that shows a changed or enlarged or upgraded configuration of the boom 14 compared to the first embodiment of FIGS. 1 and 2. The boom 14 includes a second carrier 44, that is guided or supported in bearings for telescoping in the first carrier 20 and that can be extended or retracted by means of a hydraulic arrangement (not shown). Here the attaching flange 22 for the front piece 18 is rigidly connected to (preferably welded), and is non-removable from, the second carrier 44. As is shown in FIG. 4, the front piece 18 with the mating flange 24 is attached in the same way at the attaching interface 22. Here the configuration of the front piece 18 is the same as the first embodiment shown in FIGS. 1 and 2. The second embodiment of a telescopic loader 10, shown in FIGS. 3 and 4, also makes possible the extension and retraction of the boom 14 in addition to a lifting and lowering function of the boom 14, as in the first embodiment which corresponds to a wheel loader. The extension and retraction of the boom 14 makes it possible to increase the radius of action of the vehicle 10.

In the same way, further enlargements of the second embodiment described here are possible. Here the modular configuration makes it possible to enlarge the arrangement by rebuilding the front piece 18, the boom 14 and one or more enlargement carriers (not shown here) guided in telescopic manner, where then the attaching flange 22 is welded in place to the front end of the boom 14 or to the last enlargement carrier to which the front piece can then again be fastened.

Figure 5:
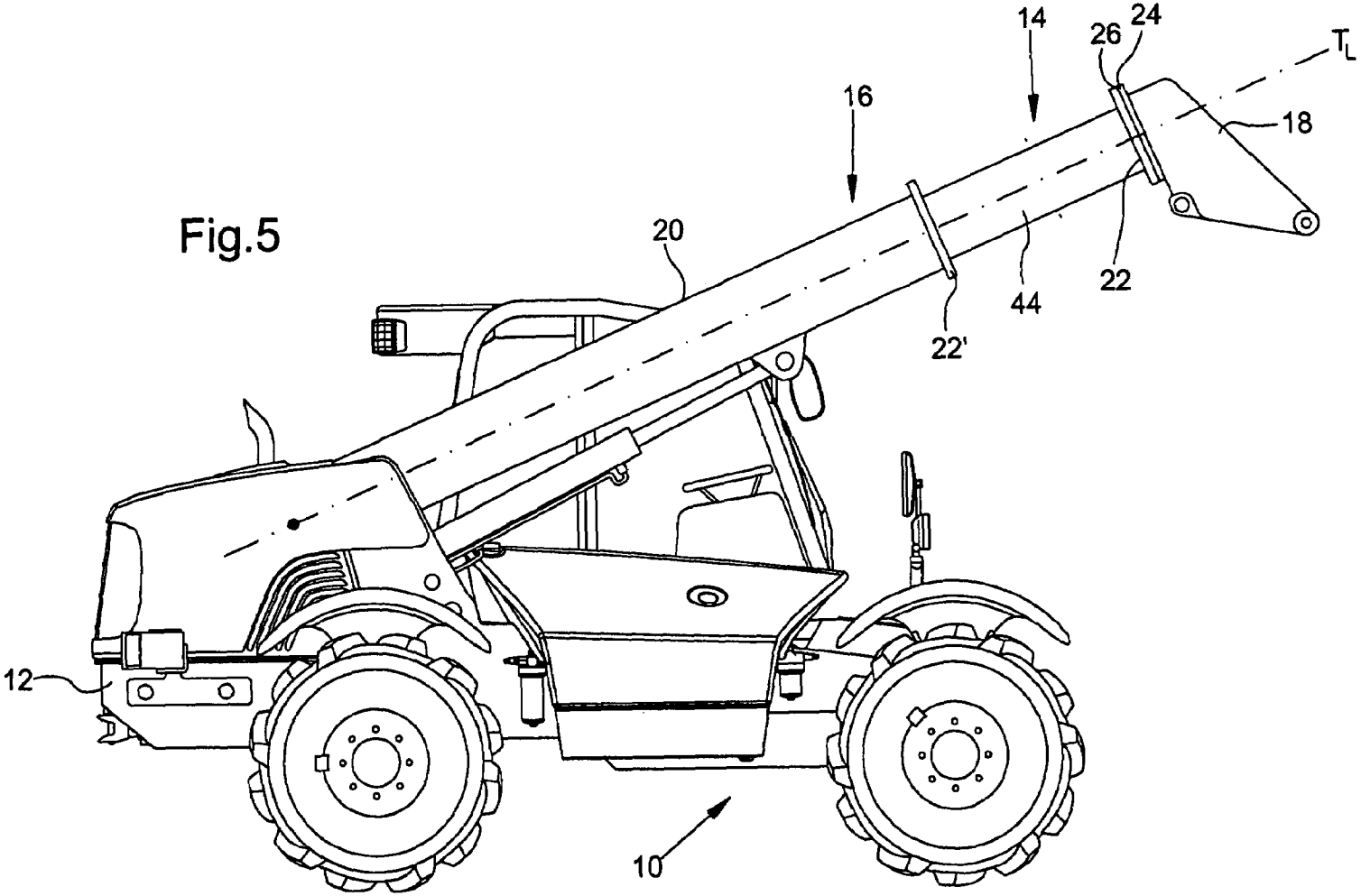
FIG. 5 is a right side view of a telescopic loader equipped with a boom including a third embodiment of the carrier arrangement constructed according to the invention.
Figure 6:
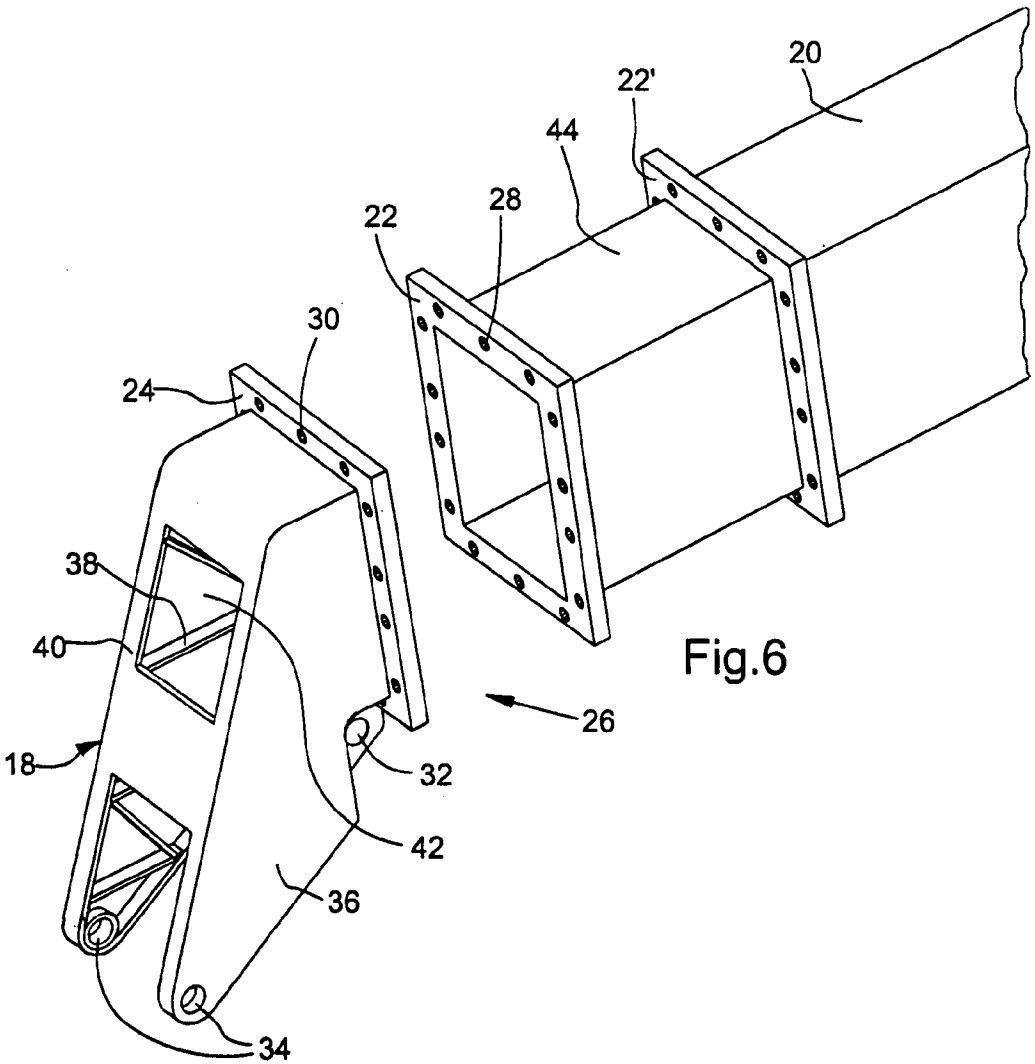
FIG. 6 is an exploded perspective view of the carrier arrangement shown in FIG. 5.

A third embodiment is shown in FIGS. 5 and 6. This embodiment corresponds generally to the second embodiment of FIGS. 3 and 4, with the difference that a further attaching flange 22' is fastened to the first carrier 20 and the carrier arrangement 16 of the boom 14, as is shown also by the first embodiment in FIGS. 1 and 2. Here a user is offered the option of downsizing the telescopic loader 10 if necessary. Here the modular configuration makes it possible to remove the front piece 18 and to remove the second carrier 44 and to again attach the front piece 18 to the further attaching flange 22'. The telescopic loader can again be upgraded by proceeding in reverse order. Here the configuration of the front piece 18 is the same as in the first embodiment shown in FIGS. 1 and 2. The further attaching flange 22' is installed during normal operation of the telescopic loader 10 and arranged in such a way that the second carrier 44 can be retracted or extended without any interference. In the same way, expanded embodiments can also contain further attaching flanges 22', that are installed at the end of each enlargement carrier and that simplify modification or an upgrade or a re-building.

Figure 7:
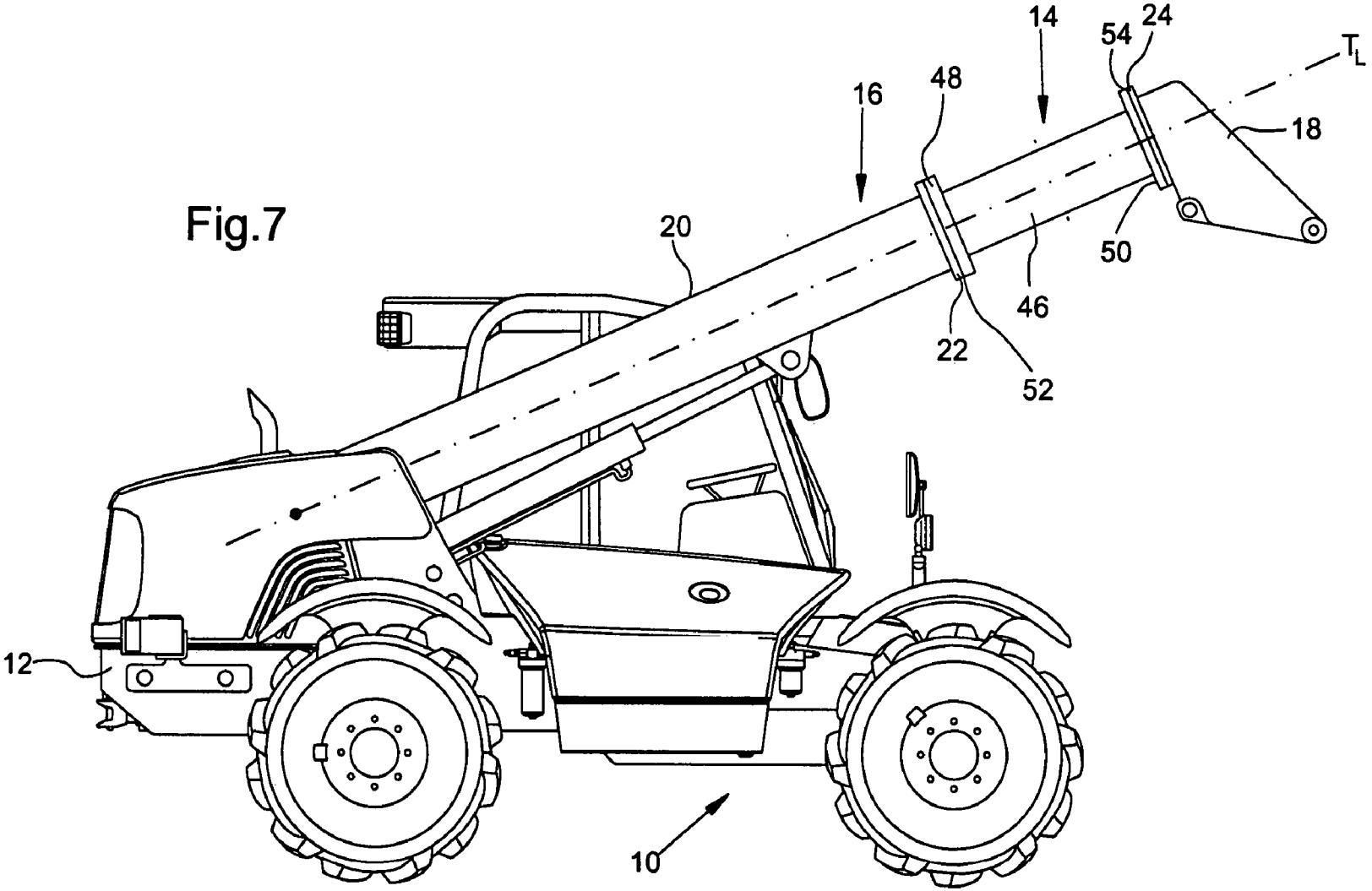
FIG. 7 is a right side view of a telescopic loader equipped with a boom including a carrier arrangement constructed according to a fourth embodiment of the invention.
Figure 8:
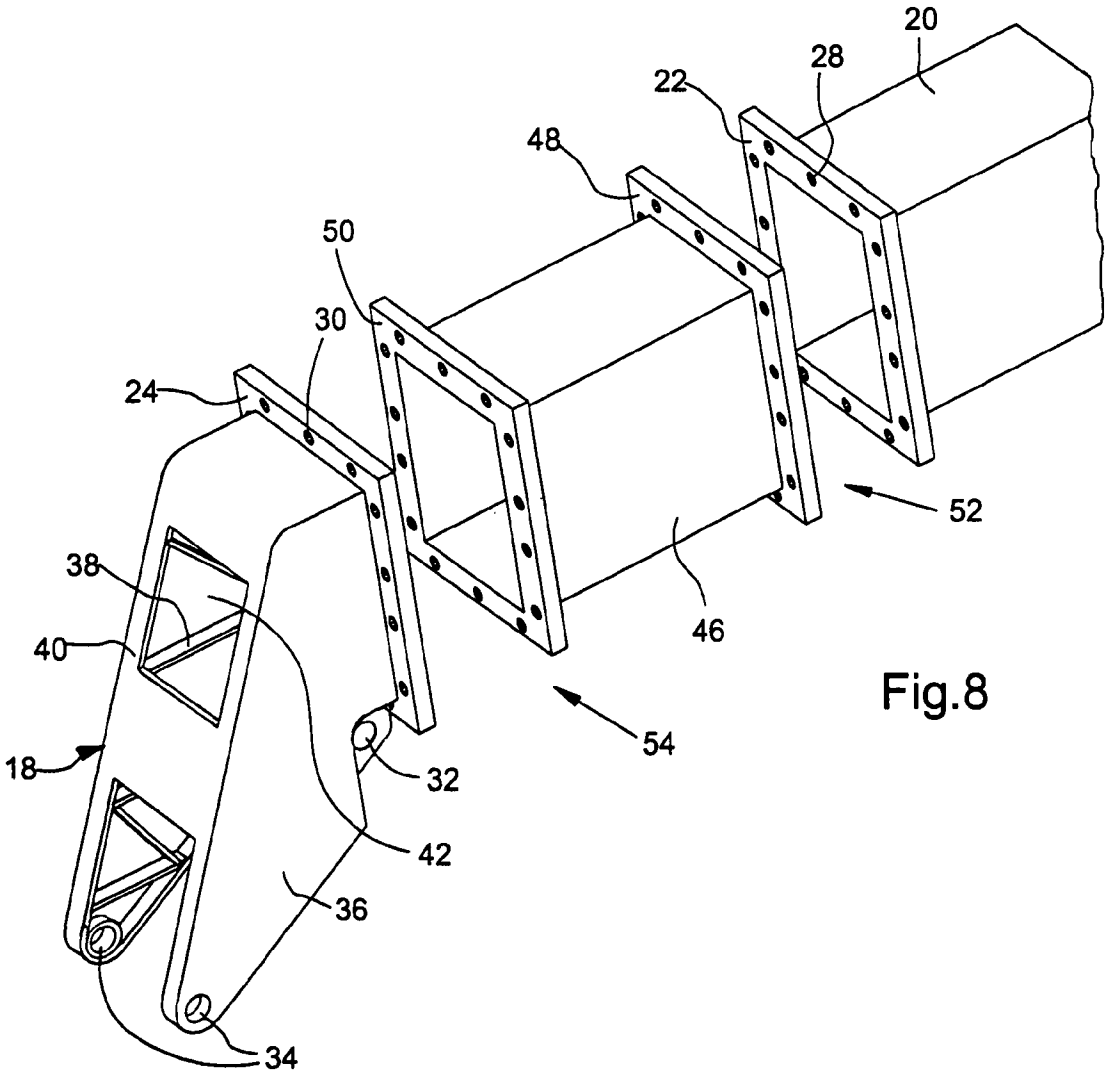
FIG. 8 is an exploded perspective view of the carrier arrangement shown in FIG. 7.

A fourth embodiment is shown in FIGS. 7 and 8. Here the boom 14 contains an extension carrier 46 inserted between the carrier arrangement 16 and the front piece 18. The extension carrier 46 contains a further mating flange 48 as well as a further attaching flange 50, that are configured in the same way as the corresponding flanges in the first through third embodiments. According to FIG. 8, the attaching flange 22 of the carrier 20 forms a flange connection interface 52 with the further mating flange 48 of the extension carrier 46, and the further attaching flange 50 of the extension carrier 46 form a flange connection interface 54 with the mating flange 30 of the front piece 18, where the flange connection interfaces 52, 54 are manufactured in the same way as the flange connection interface 26 in FIGS. 1 through 6. The extension carrier 46 supplements the modular configuration of the boom 14 to great advantage. The modular configuration explained in the embodiment in combination with the extension carrier 46 permits, in nearly any desired way, the configuration of the boom 14 to be varied and therewith also the radius of action or the functionality of the vehicle by modification, upgrading or rebuilding. The configuration of the front piece 18 is here the same as in the first embodiment shown in FIGS. 1 and 2. Beginning with the first embodiment of FIGS. 1 and 2, the carrier arrangement can be extended by the extension carrier 46, as is shown in FIGS. 7 and 8. For this purpose, the front piece 18 is removed from the carrier 20 and the extension carrier 46 is attached to the flange of the carrier 20. Following this the front piece 18 is attached to the flange of the extension carrier 46. In this way the operating height of the boom 14 can be increased. For special application this may provide a particular advantage to the user, since in this way no considerable investments are necessary for the enlargement of the boom. A similar extension by the extension carrier 46 is also possible for the boom shown in the second and third embodiment. In this case the extension carrier 46 is inserted between the second carrier 44 and the front piece 18. Moreover it is also possible to insert a further extension carrier or several extension carriers, or to offer for sale the extension carrier 46 in various configurations with differing lengths.

Although the invention has been described in terms of only four embodiments, anyone skilled in the art will perceive many varied alternatives, modifications and variations in the light of the above description as well as the drawing, all of which fall under the present invention.

Having described the preferred embodiment, it will become apparent that various modifications can be made without departing from the scope of the invention as defined in the accompanying claims.

The invention claimed is:

1. A boom for a loader, comprising: a carrier arrangement including a first carrier, a second carrier and an extension carrier; said first carrier having one end adapted for being fastened to a frame of the loader for pivoting vertically about a horizontal axis, having a second end defined by a first attaching flange, and defining a receptacle adapted for selectively receiving said second carrier in a guided, telescoping manner; said second carrier having an exposed end defined by a second attaching flange; said extension carrier having opposite ends respectively defined by a first mating flange and third attaching flange, with said first mating flange being adapted for abutting and being selectively releasably fastened either to said first attaching flange, in the absence of said second carrier, or to said second attaching flange, when said second carrier is installed; and a front piece adapted for being fastened to a tool and including a second mating flange adapted for abutting and being releasably secured to one of said first, second and third attaching flanges, whereby said extension may be selectively attached to said first carrier or to said second carrier and said front piece may alternatively be attached either to said first carrier or said second carrier or to said extension.

2. The boom, as defined by claim 1, wherein said front piece includes at least one cast component.

3. The boom, as defined in claim 2, wherein said front piece is generally configured as a cast component.

4. The boom, as defined in claim 1, wherein said first and at least second carriers are each configured as one of round, box or multi-edge profiles.

5. The boom, as defined in claim 1, wherein said carrier arrangement includes a central, longitudinal axis; and each attaching and each mating flange of said carrier arrangement extends one of toward said longitudinal axis, or away from said longitudinal axis from respective outer surface regions of said carrier arrangement.

6. The boom, as defined in claim 5, wherein each of said attaching and mating flanges are arranged one of perpendicular or inclined to said longitudinal axis.

7. The boom, as defined in claim 1, wherein one of said attaching and mating flanges is provided with a first set of threaded holes, and another of said attaching and mating flanges is provided with a second set of holes which are aligned with said first set of holes; and a set of screws releasably securing said mating and attaching flanges together.

* * * * *